United States Patent [19]

Fakhoury

[11] Patent Number: 4,591,162

[45] Date of Patent: May 27, 1986

[54] DECK OR PACK OF CARDS FOR PLAYING MULTIPLE LOTTERY GAMES

[76] Inventor: Joseph I. Fakhoury, 4640 N. Central Park, Chicago, Ill. 60625

[21] Appl. No.: 657,682

[22] Filed: Oct. 4, 1984

Related U.S. Application Data

[63] Continuation-in-part of Ser. No. 565,701, Dec. 27, 1983, abandoned.

[51] Int. Cl.[4] ..... A63F 1/04

[52] U.S. Cl. ..... 273/303; 273/138 R; 273/306

[58] Field of Search ..... 273/138 R, 292, 299, 273/303, 304, 305, 306

[56] References Cited

U.S. PATENT DOCUMENTS

| | | | |
|---|---|---|---|
| 742,498 | 10/1903 | Roy | 273/299 |
| 832,576 | 10/1906 | Gifford | 273/292 |
| 1,484,564 | 2/1924 | Riffert | 273/292 |
| 2,526,300 | 10/1950 | Todd | 273/278 |

*Primary Examiner*—Anton O. Oechsle

*Attorney, Agent, or Firm*—McCaleb, Lucas & Brugman

[57] ABSTRACT

A deck or pack of cards for playing multiple lottery games of the kind conducted or sponsored by various state governments or agencies. Examples of such games are "LOTTO", and subsidiary "PICK 4" and the "DAILY GAME" games where the odds favoring the "house" depend on the total of the numbers from which playing numbers are picked. The deck comprises a full set of cards including at least a multiple of ten cards with or without additional cards displaying a first, non-repeating group of numbers starting from a low of "01" up to a high equal to the total number of cards in the full set. At least some of the cards are subdivided and classified into a plurality of separate suits, each suit having a like number of cards displaying a second group of numbers repeated identically on the cards in each suit. In one example, to play a "6/40" LOTTO game, and subsidiary games, a full set of forty cards consecutively display a first group of two-digit numbers from "01" through "40" and the second digits in each are diagonally offset and color-coded to classify the cards into four suits each displaying a second group of one-digit numbers "0" through "9". In another example, to play a "6/44" LOTTO game, and subsidiary games, four extra cards are added to bring the full set to forty four cards.

10 Claims, 5 Drawing Figures

SUIT 30
22
28
22
24
20

SUIT 32
24
22
28
22

SUIT 34
28
22
22
24

DECK OR PACK OF CARDS FOR PLAYING MULTIPLE LOTTERY GAMES

This application is a continuation-in-part of Ser. No. 06/565,701 filed Dec. 27, 1983 abandoned.

BACKGROUND OF THE INVENTION

In most states of the United States and in some foreign countries, government-conducted or sponsored lotteries provide a great deal of amusement for large numbers of people and generate substantial revenues for many worthwhile general welfare purposes including elementary, secondary and higher education, tax relief for the elderly, local revenue sharing, and other important human service related programs.

In Illinois, for example, the Illinois State Lottery, reporting directly to the Illinois Department of Revenue, conducts three lottery games, namely, a major or basic game "LOTTO", and two subsidiary games, "PICK 4" and the "DAILY GAME".

LOTTO, sometimes referred to as the "6/40" or "6/44" game, involves picking a combination of six numbers from 1 through 40 or 44 with odds ranging upwards from about two million of winning a grand prize of one to several million dollars. PICK 4 involves picking a four-digit number from 0000 through 9999 with odds of one in 10,000 of winning up to $5000. The DAILY GAME involves picking a three-digit number from 000 through 999 with odds of one in 1,000 of winning up to $500.

At the drawing to determine the "6/40" or "6/44" LOTTO winner, forty balls numbered from "01" to "40" or "44" are thoroughly mixed in a machine and balls with the six winning numbers are then drawn from it at random. At the drawing for the PICK 4 game, ten balls numbered from "0" to "9" are thoroughly mixed in each of four separate machines and one numbered ball is drawn at random from each. Similarly, at the drawing for the DAILY GAME, nine balls numbered from "0" to "9" are thoroughly mixed in each of three machines and one numbered ball is drawn at random from each.

At least seventeen other states have identical lottery games and many others have closely similar ones. Canada, and some of the states in the United States have socalled "6/49" lottery games comparable to the above described "6/40" and "6/44" LOTTO games except that the six number combination is picked from a group of forty nine numbered balls instead of forty or forty four, thereby even further reducing the odds in favor of the player.

An interesting aspect of human betting behaviour is that many people feel more comfortable with a psychological crutch of some kind for selecting a playing number. People will pick numbers based on the calendar date, someone's birthday, a street address or automobile license number, and sometimes will pick them from numbered slips of paper. For whatever reason, many people prefer to select game playing numbers with some such help.

SUMMARY OF THE INVENTION

It is a general object of the present invention to provide a deck or pack of cards for playing multiple lottery games with which forecasts of game results may be made upon random principles corresponding to those on which the actual winning numbers are drawn.

Another object of the invention is to provide a deck of cards displaying a first or major group of numbers equivalent to a group of numbers in a first or major lottery game, and dividing or classifying the cards by color or otherwise into a plurality of suits each of which has a like number of cards displaying a second or minor group of numbers repeated identically on the cards in each suit.

Another object is to provide a single deck of cards which can be used to play both a major lottery game such as LOTTO and subsidiary games such as PICK 4 and the DAILY GAME.

Without reference to specific lottery games, another object of the present invention is to provide a full set of cards displaying a first group of numbers all of which are different and correspond to the numbered pieces or balls used at a drawing in a first lottery game, from which cards individual ones can be dealt to pick a first playing number in a random manner simulating the random manner the winning number is determined at the drawing for the first lottery game; some or all of the full set of cards being subdivided and classified into a plurality of suits each displaying a second group of numbers repeated identically in each suit and corresponding to the numbered pieces or balls used in selecting portions of a winning number at a second lottery game drawing, from which individual suits cards can be selected to pick individual portions of a second playing number in random manner simulating the random manner the individual portions of the winning number are determined at the drawing for the second lottery game.

BRIEF DESCRIPTION OF THE DRAWING

Other objects and advantages will be apparent from the following description taken in connection with the drawings in which.

Like parts are designated by like reference characters throughout the figures of the drawing.

DESCRIPTION OF THE PREFERRED EMBODIMENTS

Figures 1, 2, 3:
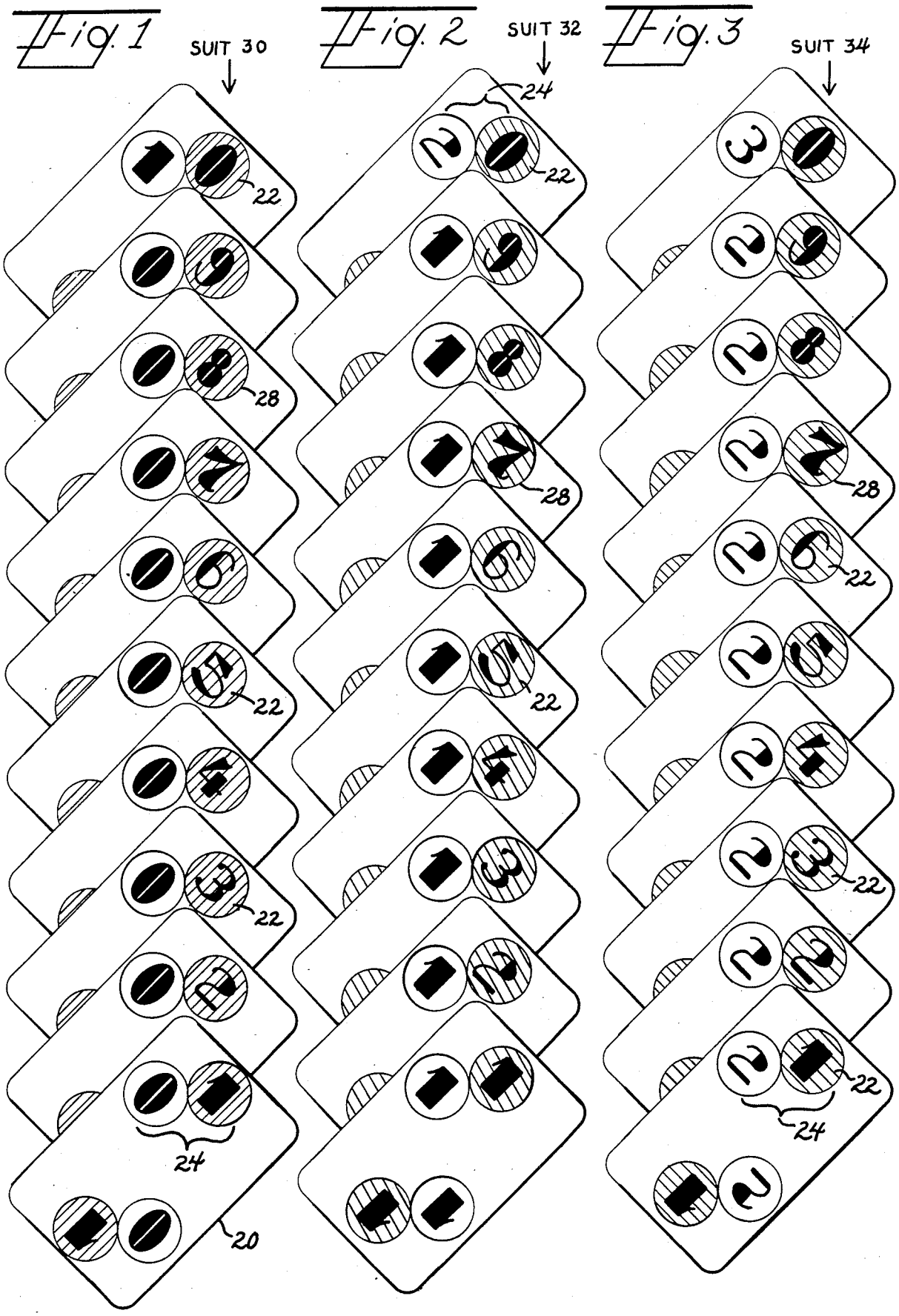
FIGS. 1, 2, 3 and 4 show a preferred form of the present invention in a full set of forty cards, divided and classified into four suits as shown respectively in each of those figures, for playing a "6/40" lottery game and certain subsidiary lottery games associated therewith.
Figure 4:
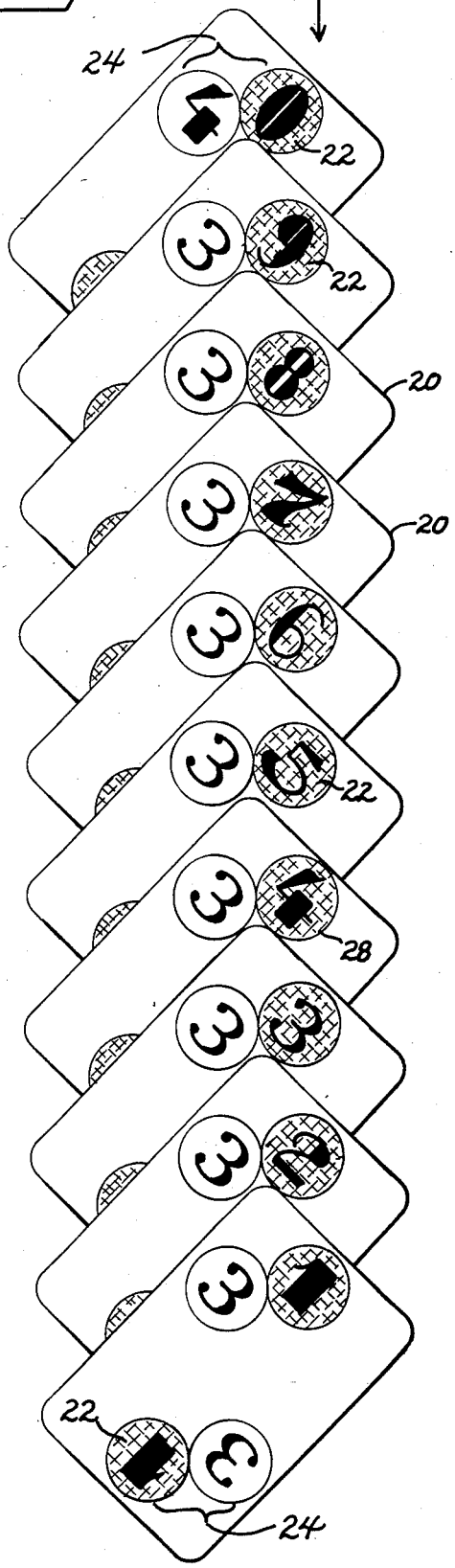

Referring now more specifically to the embodiments of the invention shown in the drawing, a full set of cards for playing a major lottery game such as the "6/40" LOTTO game, and subsidiary games such as PICK 4 and the DAILY GAME is shown in FIGS. 1–4. These are played in at least seventeen states. Similar lottery games are played in other states and in Canada.

The "6/40" LOTTO game is played by picking a combination of six numbers from "1" through "40". The odds for winning the grand prize are one in almost two million, but the grand prize on a pari-mutuel basis is $1,000,000 or more at each lottery drawing. At the drawing, typically, forty balls numbered from "1" through "40" are thoroughly mixed in a machine and six balls with the winning numbered combination are dealt out of the machine at random.

The subsidiary or minor PICK 4 game is played by picking one of 10,000 four digit numbers from 0000 to 9999. At the drawing, four numbers are picked from four machines, each machine having ten balls numbered from "0" to "9". The machines are activated one after the other, one numbered ball being picked from each to draw a four-digit winning number. Odds are one in 10,000 of winning up to $5,000.

The subsidiary or minor DAILY GAME is played similarly to the PICK 4 game by picking one of 1,000 three digit numbers from 000 to 999. At the drawing, three numbers are picked from three machines, each machine having ten balls numbered from "0" to "9". The machines are activated one after the other, one numbered ball being picked from each, to deal out the balls showing the winning number. Odds are one in 1,000 of winning up to $500.

An example of a single deck or pack of cards for playing the LOTTO, PICK 4 and DAILY GAME lottery games is shown in FIGS. 1–4. This consists of a full set of forty cards 20 displaying a first, major, non-repeating group of two-digit numbers 24 from "01" to "40".

Each second digit 22 in these two digit numbers is offset diagonally from the first, and located near the edge of the card to facilitate easy recognition of it as one of a second or minor group of numbers from "0" to "9" as will be described.

The cards are subdivided into four suits of ten cards each and are color-coded for easy recognition by coloring the circle 28 surrounding the second digit 22 of each two-digit pair 24. The suits may be colored red, green, blue and yellow as shown for example in FIGS. 1, 2, 3 and 4 respectively but any other colors, or suit-identification symbols such as hearts or diamonds, etc. (not shown) would be equally suitable. It is important that each suit has a like number of cards displaying the numerals "0" through "9" in the second digits 22 of each two-digit pair 24 because these second digits are used in playing the subsidiary PICK 4 and DAILY GAME games.

This will provide four suits, 30,32 34 and 36, in each of which the second digits 22 of the two digit pairs 24 comprise a group "0" through "9" repeated identically on the cards in each suit as follows:

01–10 (FIG. 1)
11–20 (FIG. 2)
21–30 (FIG. 3)
31–40 (FIG. 4)

To play the "6/40" LOTTO game with a deck of cards shown in FIGS. 1–4, the full set is shuffled and six cards are dealt out at random. For example, if the numbers 01-13-18-22-33-37 are displayed on the six cards, this can be the combination played in the LOTTO game. Subsequently, at the LOTTO lottery drawing, a machine containing exactly forty thoroughly mixed balls numbered from "01" to "40" is activated to deal out six balls at random. The numbers on the balls are the winning LOTTO combination. Thus, the random selection of the playing number combination from the forty-card deck exactly simulates the random selection of the winning number combination from the forty balls dealt out by the machine drawing.

To play the PICK 4 game, the deck is separated into the individual suits shown in each of FIGS. 1, 2, 3 and 4 respectively. The ten cards in each suit are shuffled independently and one card is dealt at random from each suit. If, for example, the second digits 22 in those cards are "3", "5", "1" and "6", the four digit number "3516" can be the number played in the PICK 4 game. Subsequently, at the PICK 4 lottery drawing, four separate machines, each having exactly ten thoroughly mixed balls numbered from "0" through "9" are activated in succession to deal out one ball at random from each. The four digit number shown on the four balls is the winning PICK 4 number.

The DAILY GAME is played in the same manner as the PICK 4 game except that only three suits are used to select the playing number.

To play the DAILY GAME, the deck is separated into the individual suits shown in FIGS. 1, 2, 3 and 4. One of the suits is discarded. The ten cards in each of the three remaining suits are shuffled independently and one card is dealt randomly from each suit. If, for example, the second digits 22 on the selected cards are "1", "2", and "3", the three-digit number "123", can be played in the DAILY GAME. Subsequently, at the DAILY GAME lottery drawing, three separate machines each having exactly ten thoroughly mixed balls numbered from "0" through "9" are successively activated to deal out one ball at random from each. The three digit number shown on the three balls is the winning DAILY GAME number.

Thus, the random selection of the playing numbers from the second digits 22 on the cards exactly simulates the random selection of the winning numbers on the balls at the PICK 4 and DAILY GAME drawings.

A game similar to the above described "6/40" LOTTO game is played in Canada, and in a few states in the United States. It uses forty nine cards and is sometimes referred to as the "6/49" game because the six number winning combination is drawn from a total of forty nine balls numbered from "1" through "49", so the odds are somewhat longer than in the "6/40" game.

Figure 5:
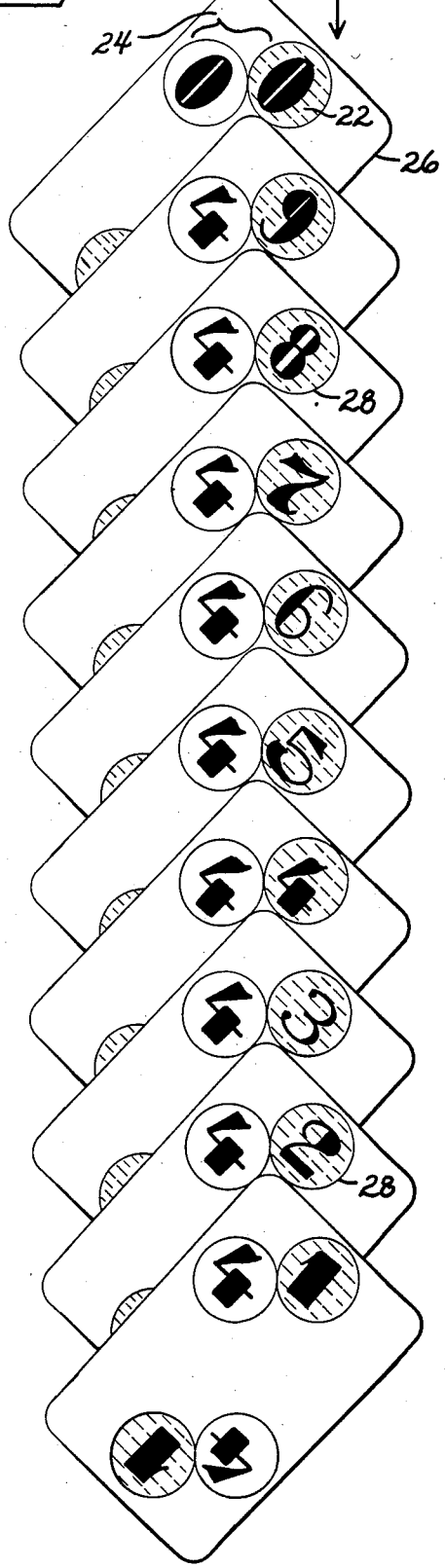
FIG. 5 shows an additional ten cards which could be added to the cards shown in FIGS. 1–4 for playing a "6/49" lottery game and other lottery games and certain subsidiary lottery games associated therewith.

To play the "6/49" LOTTO game, another suit 38 of ten cards consisting of nine numbered "41" through "49" and one card 26 is provided as shown in FIG. 5. The suit may be identified by a fifth color, the second digits 22 being lined for silver as one example shown in FIG. 5. Alternatively, the five suits may be identified by clubs, diamonds, hearts or other distinctive symbols or markings (not shown).

Playing the "6/49" LOTTO game, the "00" card 26 is discarded, the remaining forty nine card deck shown in FIGS. 1–5 is shuffled and six cards are dealt out at random to pick a six number playing combination. At the lottery drawing, six numbered balls will be dealt out from forty nine thoroughly mixed balls in the machine to determine the winning number.

Subsidiary games such as PICK 4 and the DAILY GAME, and others such as a possible PICK 5, may be played with the forty nine card deck, by adding the "00" card 26 (FIG. 6) to the deck shown in FIG. 5. This will provide five suits, each with the second group of numbers 22 consisting of the group 0 through 9 repeated identically on the cards in each suit as follows:

01–10 (FIG. 1)
11–20 (FIG. 2)
21–30 (FIG. 3)
31–40 (FIG. 4)
41–49+00 (FIG. 5)

The PICK 4 and the DAILY GAME would be played as described in connection with the "6/40" deck by selecting four and three suits respectively from the five suits listed above.

It will be apparent that the odds for or against the player can be adjusted simply by varying the total number from which the playing numbers are selected. For example, in the "6/40" LOTTO game described above, where six playing numbers are picked from a total of forty, the odds in favor of the player are higher than in the "6/49" LOTTO game described where the playing numbers are picked from a total of forty nine. Where the odds are adjusted in this manner, the total number of cards may be varied accordingly.

For example, if the largest number of the group from which the playing numbers are selected is 41 (instead of 40 or 49, in the specific examples given), a "6/41" LOTTO game playing number can be selected from a deck of cards consisting of suits 30, 32, 34 and 36, plus an extra card with the numeral 41 from suit 38. Similarily, if the largest number of the group from which the playing numbers are selected is one of those between 42 and 48, the appropriate number of extra cards from suit 38 may be selected so the total number of cards equals that largest number of the group from which the playing numbers are selected.

At least one state has recently reduced the odds in favor of the player by changing from a "6/40" to a "6/44" LOTTO game and other states are expected to follow. For playing such "6/44" LOTTO game and the subsidiary "PICK 4" and "DAILY GAME" games with the present invention, a full set of 44 cards would be used consisting of the four suits 30, 32, 34 and 36 plus extra cards numbered "41" through "44" from suit 38. "LOTTO" would be played by selecting six cards from the full set to pick a 6-number playing combination. "PICK 4" would be played by selecting one of the second digits from each of suits 30 through 36 to pick a 4-digit playing combination. And the "DAILY GAME" would be played by selecting one of the second digits from three of those suits to pick a 3-digit playing combination.

The embodiments described and shown to illustrate the present invention have been necessarily specific for purposes of illustration. Alterations, extensions and modifications would be apparent to those skilled in the art. The aim of the appended claims, therefore, is to cover all variations included within the spirit and scope of the invention.

The embodiments of the invention in which an exclusive property or privilege is claimed are defined as follows:

1. A deck of cards for playing multiple lottery games with which forecasts of game results may be made upon random principles corresponding to those on which the actual winning numbers are drawn comprising:

a full set of cards including at least forty cards, said full set of cards displaying a first, non-repeating group of numbers from a low of "01" to a high of "40";

suit marking means for subdividing and classifying at least some of said full set of cards into a plurality of separate suits equal to a multiple of ten, each suit having the same number of cards displaying a second group of numbers comprising ten digits "0" through "9" repeated identically on the cards in each suit;

whereby one lottery game may be played by randomly picking cards from said full set to make selections from said first group of numbers; and whereby further secondary lottery games may be played by randomly picking cards from predetermined ones of said suits to make selections from said second set of numbers.

2. A deck of cards according to claim 1 in which said first group of numbers "01" through "40" are subdivided and classified into four separate suits as follows:

(a) 01, 02, 03, 04, 05, 06, 07, 08, 09, 10
(b) 11, 12, 13, 14, 15, 16, 17, 18, 29, 20
(c) 21, 22, 23, 24, 25, 26, 27, 28, 29, 30
(d) 31, 32, 33, 34, 35, 36, 37, 38, 39, 40;

whereby a combination of numbers from "01" through "40" can be selected from the full set of cards to play said one lottery game; and whereby further numbers from "0" through "9" can be chosen from the second digits in selected ones of said suits to play said secondary lottery games.

3. A deck of cards according to claim 2 in which the second digit in each of the two-digit numbers in said suits is emphasized to provide four series of easily recognizable single digits from "0" through "9" in each suit.

4. A deck of cards according to claim 1 in which there are fifty cards in said full set and said first group of numbers includes the numbers "00" and "41" through "49", said cards being subdivided and classified into five separate suits as follows:

(a) 01, 02, 03, 04, 05, 06, 07, 08, 09, 10
(b) 11, 12, 13, 14, 15, 16, 17, 18, 19, 20
(c) 21, 22, 23, 24, 25, 26, 27, 28, 29, 30
(d) 31, 32, 33, 34, 35, 36, 37, 38, 39, 40
(e) 41, 42, 43, 44, 45, 46, 47, 48, 49, 00;

whereby, by discarding said cards numbered "00", a combination of numbers from "1" through "49" can be selected to play said one lottery game; and whereby further, by including said card numbered "00" and choosing numbers from selected ones of said suits, other combinations of numbers can be selected from said suits to pay said secondary lottery games.

5. A deck of cards according to claim 4 in which the second digit in each of the two-digit numbers in said suits is emphasized to provide five series of easily recognizable single digits from "0" through "9" in each suit.

6. A deck of cards for playing multiple lottery games with which forecasts of game results may be made upon random principles corresponding to those on which the actual winning numbers are drawn comprising:

a full set of cards totaling forty plus a predetermined number of one or more extra cards, said full set of cards displaying a first, non-repeating group of numbers from a low of "01" to a high equal to the total number of said full set of cards;

suit marking means subdividing and classifying said forty cards into four separate suits of ten cards each, each suit having the same number of cards displaying a second group of numbers repeated identically on the cards in each suit;

whereby one lottery game may be played by randomly picking cards from said full set to make selections from said first group of numbers; and whereby further secondary lottery games may be played by randomly picking cards from predetermined ones of said suits to make selections from said second set of numbers.

7. A deck of cards according to claim 6 in which each said second group of numbers comprises ten digits from "0" to "9" respectively.

8. A deck of cards according to claim 6 in which the predetermined number of extra cards is in the range of one through ten.

9. A deck of cards according to claim 6 in which said forty cards are subdivided and classified into four separate suits as follows:

(a) 01, 02, 03, 04, 05, 06, 07, 08, 09, 10

(b) 11, 12, 13, 14, 15, 16, 17, 18, 19, 20

(c) 21, 22, 23, 24, 25, 26, 27, 28, 29, 30

(d) 31, 32, 33, 34, 35, 36, 37, 38, 39, 40;

and said extra cards are numbered beginning "41" to a highest number equal to the total number of said full set of cards;

whereby a combination of numbers from "01" through said highest number can be selected to play said one lottery game; and whereby further numbers from "0" through "9" can be chosen from the second digits in selected ones of said suits to play said secondary lottery games.

10. A deck of cards according to claim 9 in which the second digit in each of the two-digit numbers in said suits is emphasized to provide four series of easily recognizable single digits from "0" through "9" in each suit.

* * * * *